US008820475B2

(12) United States Patent
Pradhan

(10) Patent No.: US 8,820,475 B2
(45) Date of Patent: Sep. 2, 2014

(54) EXHAUST MUFFLER

(71) Applicant: Caterpillar Inc., Peoria, IL (US)

(72) Inventor: Rajdeep Pradhan, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/705,202

(22) Filed: Dec. 5, 2012

(65) Prior Publication Data

US 2014/0151148 A1 Jun. 5, 2014

(51) Int. Cl.
*F01N 1/08* (2006.01)

(52) U.S. Cl.
USPC ..... 181/266; 181/268; 181/272; 181/275

(58) Field of Classification Search
USPC ..... 181/238, 239, 253, 257, 264, 266, 268, 181/272, 275, 276
See application file for complete search history.

(56) References Cited

U.S. PATENT DOCUMENTS

| | | | | | |
|---|---|---|---|---|---|
| 763,221 | A * | 6/1904 | Ullom | 181/269 |
| 2,809,709 | A | 10/1957 | Billey | |
| 2,833,368 | A * | 5/1958 | Lowther | 181/240 |
| 2,958,389 | A * | 11/1960 | Deremer | 181/266 |
| 3,103,256 | A * | 9/1963 | Deremer | 181/266 |
| 4,333,544 | A * | 6/1982 | Seeger | 181/266 |
| 4,673,058 | A * | 6/1987 | Roberts et al. | 181/266 |
| 5,025,890 | A * | 6/1991 | Hisashige et al. | 181/272 |
| 5,559,308 | A * | 9/1996 | Hayashi | 181/265 |
| 5,739,483 | A | 4/1998 | Yashiro et al. | |
| 6,158,214 | A * | 12/2000 | Kempka et al. | 60/302 |
| 6,241,044 | B1 | 6/2001 | Nishiyama et al. | |
| 6,571,911 | B2 * | 6/2003 | Watanabe et al. | 181/265 |
| 6,832,665 | B2 * | 12/2004 | Crombeen | 181/275 |
| 2004/0238272 | A1 * | 12/2004 | Wan et al. | 181/251 |
| 2009/0145689 | A1 * | 6/2009 | Han | 181/272 |
| 2010/0193284 | A1 * | 8/2010 | Zheng | 181/276 |

FOREIGN PATENT DOCUMENTS

| | | |
|---|---|---|
| GB | 534568 | 3/1941 |
| WO | 2005026508 | 3/2005 |

* cited by examiner

*Primary Examiner* — Jeremy Luks
(74) *Attorney, Agent, or Firm* — John P. Wappel

(57) ABSTRACT

An exhaust muffler for an internal combustion engine including a housing having a sidewall, a first end plate and a second end plate spaced apart and located opposite the first end plate. A plurality of partitions may be disposed within the housing defining a plurality of chambers, including a resonator chamber, a cross-flow chamber, and an outlet chamber. An inlet pipe may be disposed through the housing into the resonator chamber and in fluid communication with the cross-flow chamber, the inlet pipe having a bend in the resonator chamber, wherein the inlet pipe is in fluid communication with the resonator chamber through a resonator aperture located in the bend. A resonator tube may be in fluid communication with the cross-flow chamber and the outlet chamber. An outlet pipe may be disposed through the housing and in fluid communication with the outlet chamber.

18 Claims, 2 Drawing Sheets

EXHAUST MUFFLER

The present patent application claims priority to U.S. Provisional Patent Application Ser. No. 61/671,864 which was filed on Jul. 16, 2012.

TECHNICAL FIELD

The present disclosure relates to an exhaust muffler for an internal combustion engine. In particular, the muffler of the present disclosure is directed to attenuating noise at a wide range of frequencies including low frequencies (<250 Hertz).

BACKGROUND

Excessive low frequency noise may be experienced inside a machine cab due to excitation from internal combustion engine exhaust. U.S. Pat. No. 6,241,044 discloses various embodiments of exhaust mufflers. However, it has been found that exhaust noise excitation can result can result in significant sound levels in an operator cab, which can be not only bothersome to the operator but hazardous. Typical muffler designs are tuned to a single frequency or a narrow range of frequencies. However, it is desirable for a muffler to provide noise attenuation across a range of frequencies, and in a particular application, also provide low frequency (<250 Hertz) attenuation as well.

SUMMARY

One aspect of the present disclosure is directed to an exhaust muffler for an internal combustion engine including a housing having a sidewall, a first end plate and a second end plate spaced apart and located opposite the first end plate, the housing defining a housing axis. The muffler may also include a plurality of partitions disposed within the housing defining a plurality of chambers, including a first resonator chamber, a second resonator chamber, a cross-flow chamber, and an outlet chamber. An inlet pipe may be disposed through the housing into the first resonator chamber, the inlet pipe including a bend located within the first resonator chamber and defining a first inlet axis and a second inlet axis, and an aperture located in the bend and being substantially coaxial with the first inlet axis, wherein the inlet pipe is in fluid communication with the first resonator chamber. The muffler may also include a first diffuser located in the cross-flow chamber, the first diffuser including a plurality of first diffuser openings disposed in a first annular wall and a resonator tube in fluid communication with the second resonator chamber, the cross-flow chamber, and the outlet chamber. The resonator tube may include a second diffuser located in the cross-flow chamber, the second diffuser including a plurality of second diffuser openings disposed in a second annular wall, a resonator port disposed within the second resonator chamber, and a packed tube portion disposed within the outlet chamber. The muffler may also include an outlet pipe disposed through the housing and in fluid communication with the outlet chamber.

Another aspect of the present disclosure is directed to an exhaust muffler for an internal combustion engine including a housing having a sidewall, a first end plate and a second end plate spaced apart and located opposite the first end plate. A plurality of partitions may be disposed within the housing defining a plurality of chambers, including a resonator chamber, a cross-flow chamber, and an outlet chamber. An inlet pipe may be disposed through the housing into the resonator chamber and in fluid communication with the cross-flow chamber, the inlet pipe having a bend in the resonator chamber, wherein the inlet pipe is in fluid communication with the resonator chamber through a resonator aperture located in the bend. A resonator tube may be in fluid communication with the cross-flow chamber and the outlet chamber. An outlet pipe may be disposed through the housing and in fluid communication with the outlet chamber.

Another aspect of the present disclosure is an exhaust muffler for an internal combustion engine including a housing defining a housing axis. The muffler may also include an inlet pipe disposed through the housing, the inlet pipe having a bend wherein the inlet pipe is oriented substantially perpendicular to the housing axis as it enters the housing and parallel to the housing axis within the housing and an outlet pipe oriented substantially perpendicular to the housing axis and the inlet pipe.

DETAILED DESCRIPTION

Figure 1:
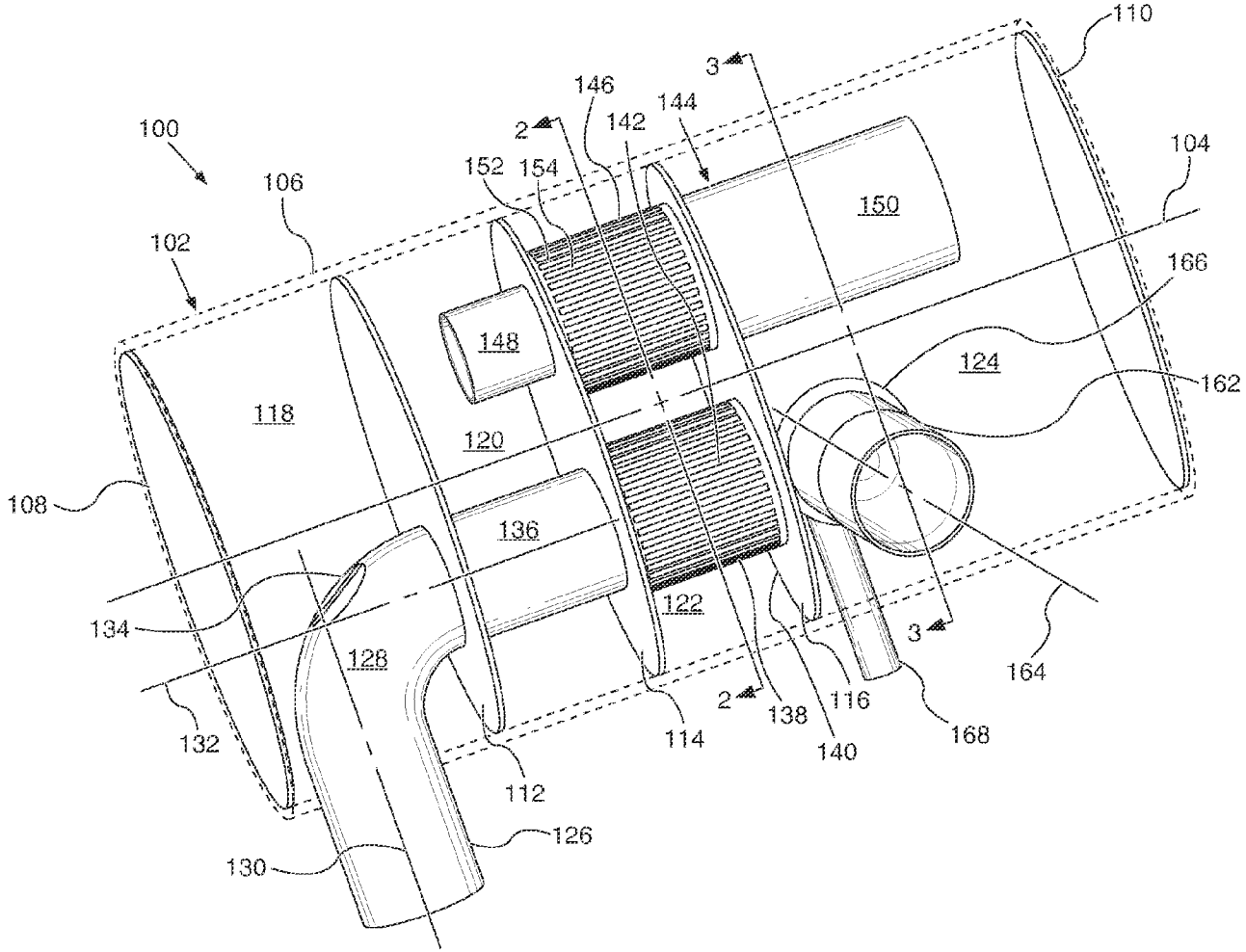
FIG. 1 is a perspective view of an embodiment of an exhaust muffler according to the present disclosure.

The present disclosure relates to an exhaust muffler for attenuating noise produced by an internal combustion engine, such as a diesel engine. Referring to FIG. 1, the muffler 100 of the present disclosure may include a housing 102 defining a housing axis 104. The housing may include generally continuous sidewall 106, a first end plate 108 located at one end of the sidewall 106, and a second end plate 110 located at a second end of the sidewall opposite the first end.

Disposed within the housing 102, the muffler 100 may include a plurality of partitions 112, 114, 116 dividing the interior of the housing 102 into a plurality of chambers 118, 120, 122, 124. The exemplary embodiment of FIG. 1 is shown as having a first partition 112, a second partition 114, and a third partition 116, which divide a space within the housing 102 into a first resonator chamber 118, a second resonator chamber 120, a cross-flow chamber 122, and an outlet chamber 124.

Muffler 100 may include an inlet pipe 126, disposed through the housing 102 and configured for fluid communication with an exhaust system of an internal combustion engine (not shown) such that exhaust gases are directed through the muffler 100. As shown in FIG. 1, the inlet pipe 126 may be disposed through the sidewall 106. Inlet pipe 126 may further include a bend 128 or elbow. The bend 128 may be configured so that the orientation of the inlet pipe 126 changes by about ninety (90) degrees, thereby defining a first inlet axis 130 and a second inlet axis 132.

The inlet pipe 126 may also include an aperture 134, for example, located in the bend 128. The aperture 134 may be coaxial with the first inlet axis 130. Further, the aperture 134 may be configured to have a smaller dimension than the inlet pipe. For example, the aperture 134 may be configured to have a diameter less than the inside diameter of the inlet pipe 126. Further, the aperture may be configured to have a diameter between about 0.5 and 0.75 times the inside diameter of the inlet pipe 126.

The inlet pipe 126 may be positioned through the sidewall 104 of the housing 102 into the first resonator chamber 118. The bend 128 or elbow may be oriented so that the inlet pipe 126 is disposed through the first partition 112 into the second resonator chamber 120. The inlet pipe 126 may include a bridge portion 136 through the second resonator chamber 120, fluidly isolating the interior of the inlet pipe 126 from the second resonator chamber 120.

The inlet pipe 126 may further be disposed through the second partition 114 and in fluid communication with the cross-flow chamber 122. An inlet diffuser 138 may be provided to provide fluid communication between the inlet pipe 126 and the cross-flow chamber 122. In the exemplary embodiment, the inlet diffuser 138 may include an annular wall 140 formed from a metal sheet (e.g. steel, aluminum, or other suitable material) defining a plurality of openings 142. The openings 142 are shown in FIG. 1 as slots or slits longitudinally formed in the annular wall 140, however other forms and orientations may also be acceptable including circumferentially or helically oriented slots, round holes or perforations, or any other configuration found to be acceptable.

The annular wall 140 may be configured to form generally cylindrical inlet diffuser 138 positioned between the second partition 114 and the third partition 116. In the exemplary embodiment, one end of the inlet diffuser 138 is attached to the second partition 114 and a second end of the inlet diffuser is attached to the third partition 116. The inlet diffuser 138 may be sized to have a larger cross-sectional area than the inlet pipe 126. For example, the inlet diffuser 138 may be configured to have a larger internal diameter than the internal diameter of the inlet pipe 126.

The muffler 100 of the present disclosure may also include a resonator tube 144. The resonator tube 144 may include a resonator diffuser 146, a resonator neck portion 148, and a packed tube portion 150. The resonator diffuser 146 may be located within the cross-flow chamber 122 and in fluid communication with the inlet diffuser 138. The resonator diffuser 146 may include an annular wall 152 formed from a metal sheet (e.g. steel, aluminum, or other suitable material) defining a plurality of openings 154. The openings 154 are shown in FIG. 1 as slots or slits longitudinally formed in the annular wall 152, however other forms and orientations may also be acceptable including circumferentially or helically oriented slots, round holes or perforations, or any other configuration found to be acceptable.

The annular wall 152 may be configured to form generally cylindrical resonator diffuser 146 positioned between the second partition 114 and the third partition 116. In the exemplary embodiment, one end of the resonator diffuser 146 is attached to the second partition 114 and a second end of the resonator diffuser 146 is attached to the third partition 116.

Although the resonator diffuser 146 may be constructed and configured similar to the inlet diffuser 138 described previously, the inlet diffuser 138 and the resonator diffuser 146 need not be identical in a particular muffler 100 embodiment. For example, each diffuser may be configured with openings of different shape and/or orientation (e.g. round holes vs. slots, round vs. elongated holes, longitudinal vs. helical slots, etc.). The inlet diffuser 138 and the resonator diffuser 142 may be configured so that of the total pressure drop across the muffler 100, approximately eighty (80) percent of the pressure drop occurs between the inlet diffuser 138 and the resonator diffuser 142.

The resonator tube 144 may include a resonator neck portion 148 in fluid communication with the resonator diffuser 146. The resonator neck portion 148 may be configured as a solid cylindrical wall attached to the second partition 114 and disposed within the second resonator chamber 120. The resonator neck portion 148 may extend from the second partition 114 to a location within the space of the second resonator chamber 120. In the exemplary embodiment, the resonator neck portion 148 terminates within the second resonator chamber 120 approximately half the distance between the first partition 112 and the second partition 114. However, the length of the resonator neck portion 148 may be adjusted, that is made longer or shorter, depending on the frequency and wavelength of the noise to be attenuated.

Figure 3:
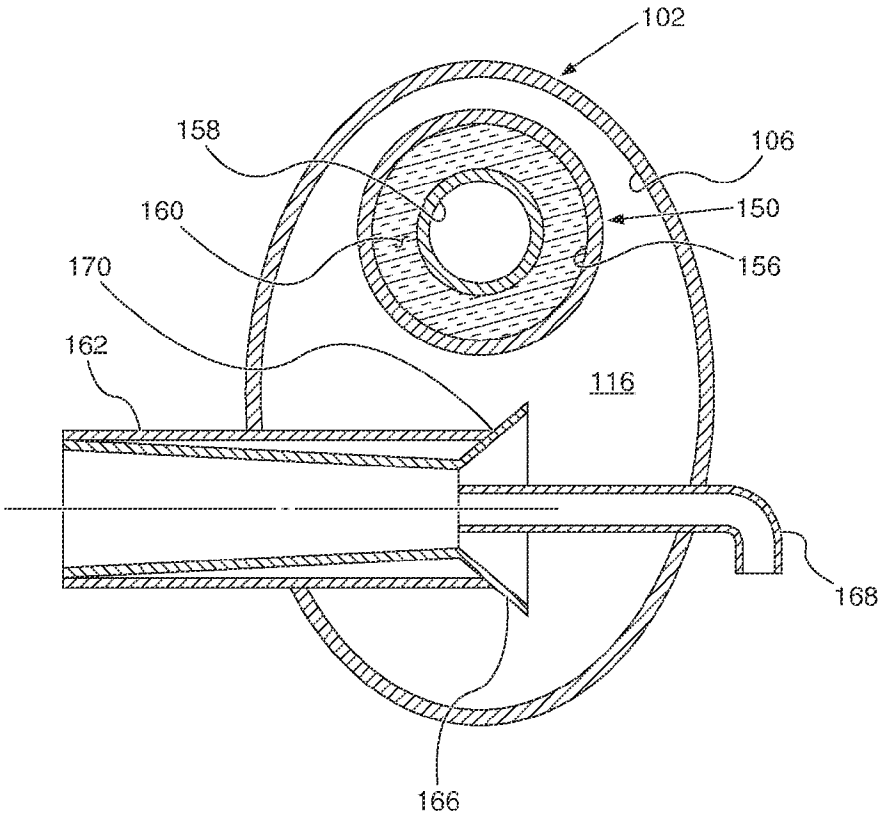
FIG. 3 is a section view of the muffler of FIG. 1 taken at line 3-3.
Figure 2:
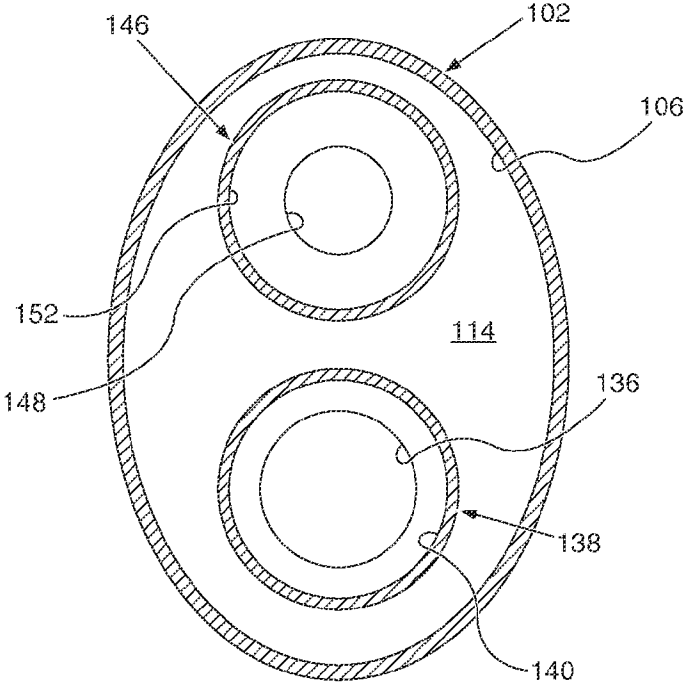
FIG. 2 is a section view of the muffler of FIG. 1 taken at line 2-2.

The resonator tube 144 may include a packed tube portion 150 in fluid communication with the resonator diffuser 146 and disposed within the outlet chamber 124. Referring to FIG. 3, the packed tube portion 150 may include an outer pipe 156, an inner pipe 158, and sound insulation material 160 disposed (or packed) between the outer pipe 156 and the inner pipe 158. The outer pipe may be of continuous constructions, without holes or perforations. The inner pipe 158 may include a number of openings or perforations (not shown), either at certain locations or along its entire length. The sound insulation material may be formed from any number of suitable materials, such as glass fibers, mineral wool, or other fibrous material. The packed tube portion 150 may be attached at one end to the third partition 116 and extending into the outlet chamber 124. In the exemplary embodiment, the packed tube portion 150 terminates within the outlet chamber 124 approximately half the distance between the third partition 116 and the second end plate 110. However, the length of the packed tube portion 150 may be adjusted, that is made longer or shorter, depending on the frequency and wavelength of the noise to be attenuated. Alternatively, the resonator tube 144 may include a straight tubular portion (not shown) in lieu of the packed tube 150, without departing from the scope of the present disclosure.

The muffler 100 of the present disclosure may further include an outlet pipe 162, disposed through the housing 102 and configured for fluid communication between the outlet chamber 124 and atmosphere. As shown in FIGS. 1 and 3, the outlet pipe 162 may be disposed through the sidewall 106. The outlet pipe may define an outlet axis 164. As shown in the exemplary embodiment, the outlet axis 164 may be oriented normal (at ninety (90) degrees) to each of the housing axis 104, the first inlet axis 130, and the second inlet axis 132.

One end of the outlet pipe 162, disposed within the outlet chamber 124, may include a venturi 166, or a converging/diverging portion. A conduit 168 may be configured to deliver a source of clean air, such as from a pre-cleaner or filter for the internal combustion engine (not shown) into the outlet pipe 162. The venturi 166 and the conduit 168 may be configured so that the venture 166 and the conduit 168 are coaxial about outlet axis 164 and also so that the throat 170 and the end 172 of conduit 168 are aligned.

INDUSTRIAL APPLICABILITY

Internal combustion engines provide power to various machines such as earth moving equipment, on-highway trucks or vehicles, off-highway trucks or machines, locomotives, generators, pumps, and other mobile and stationary applications. During operation, an internal combustion engine produces sound waves from the repeated opening of exhaust valves and the expulsion of exhaust gases as the sound waves propagate through the exhaust gas flow. The muffler 100 of the present disclosure is configured to provide attenuation of low frequency noise, and in particular, sound waves at frequencies of less than 250 Hertz.

In steady-state operation, the inlet pipe 126 of the muffler 100 of the present disclosure is connected to an exhaust pipe of an internal combustion engine. The inlet pipe 126 provides a conduit for exhaust gas to enter the muffler. The flow of exhaust gas is directed to change direction at bend 128 while sound waves propagating in the exhaust flow are allowed to enter the first resonator chamber 118, are reflected within the resonator chamber 118, and the reflected sound waves cancel with incoming waves.

The exhaust gas flow continues to the cross-flow chamber 122 where the exhaust gas flow enters through the inlet diffuser 138, which provides a high impedence boundary condition. Sound waves continuing to propagate within the exhaust gas flow are scattered by the inlet diffuser 138 and undergo further reflection and cancelling in the cross-flow chamber 122.

The exhaust gas flow passes through the resonator diffuser 146. Propagating sound waves are directed through the resonator neck portion 148 into the second resonator chamber 120, which functions as a Hemholtz resonator, meanwhile the exhast gas flow passes through the packed tube 150, where sound waves are absorbed by the sound insulation material 160.

Finally, the exhaust gas flow enters the outlet chamber 124 where further reflection and cancelling of sound waves occurs before the exhaust gas exits the muffler 100 to atmosphere through the outlet pipe 162. A ventur±166 may be provided to draw in a source of clean air into the exhaust gas flow through conduit 168. The clean air is provided to remove particulate matter, such as ash, soot, and other products of incomplete combustion, thereby mitigating clogging.

Although embodiments of this disclosure have been described herein, improvements and modifications may be incorporated without departing from the scope of the following claims.

What is claimed is:

1. An exhaust muffler for an internal combustion engine comprising:

a housing having a sidewall, a first end plate and a second end plate spaced apart and located opposite the first end plate, the housing defining a housing axis;

a plurality of partitions disposed within the housing defining a plurality of chambers, including a first resonator chamber, a second resonator chamber, a cross-flow chamber, and an outlet chamber;

an inlet pipe disposed through the housing into the first resonator chamber, the inlet pipe including a bend located within the first resonator chamber and defining a first inlet axis and a second inlet axis, and an aperture located in the bend and being substantially coaxial with the first inlet axis, wherein the inlet pipe is in fluid communication with the first resonator chamber, and a first diffuser located in the cross-flow chamber, the first diffuser including a plurality of first diffuser openings disposed in a first annular wall;

a resonator tube in fluid communication with the second resonator chamber, the cross-flow chamber, and the outlet chamber, the resonator tube including a second diffuser located in the cross-flow chamber, the second diffuser including a plurality of second diffuser openings disposed in a second annular wall, a resonator port disposed within the second resonator chamber, and a packed tube portion disposed within the outlet chamber; and an outlet pipe disposed through the housing and in fluid communication with the outlet chamber.

2. The exhaust muffler of claim 1 wherein the outlet portion of the cross-flow pipe comprises:

an inner tube having a plurality of apertures disposed therein;

a solid outer tube; and a fibrous material disposed between the inner tube and the outer tube.

3. The exhaust muffler of claim 2 wherein the fibrous material disposed between the inner tube and the outer tube comprises a fiberglass.

4. The exhaust muffler of claim 1 further comprising a port disposed in the outlet pipe configured to supply clean air into the outlet pipe.

5. The exhaust muffler of claim 1, wherein the aperture located in the bend of the inlet pipe has a diameter less than a diameter of the inlet pipe.

6. The exhaust muffler of claim 5, wherein the aperture has a diameter of about 0.5 to about 0.75 the diameter of the inlet pipe.

7. The exhaust muffler of claim 4 wherein the outlet pipe further comprises a venturi portion connected to the clean air port configured to draw clean air into the outlet pipe.

8. The exhaust muffler of claim 1 wherein the inlet pipe includes a bridge portion through the second resonator chamber, fluidly isolating the inlet pipe from the second resonator chamber.

9. An exhaust muffler for an internal combustion engine comprising:

a housing having a sidewall, a first end plate and a second end plate spaced apart and located opposite the first end plate;

a plurality of partitions disposed within the housing defining a plurality of chambers, including a first resonator chamber, a cross-flow chamber, and an outlet chamber;

a second resonator chamber in fluid communication with the cross-flow chamber;

an inlet pipe disposed through the housing into the first resonator chamber and in fluid communication with the cross-flow chamber, the inlet pipe having a bend in the first resonator chamber, wherein the inlet pipe is in fluid communication with the first resonator chamber through a resonator aperture located in the bend;

a resonator tube in fluid communication with the cross-flow chamber and the outlet chamber; and an outlet pipe disposed through the housing and in fluid communication with the outlet chamber.

10. The exhaust muffler of claim 9 further comprising a first diffuser attached to the inlet pipe and disposed within the cross-flow chamber, the first diffuser including a plurality of first diffuser openings disposed in a first annular wall.

11. The exhaust muffler of claim 10 further comprising a second diffuser attached to the resonator tube and disposed within the cross-flow chamber, the second diffuser including a plurality of second diffuser openings disposed in a second annular wall.

12. The exhaust muffler of claim 9 wherein a portion of the resonator tube comprises:

an inner tube having a plurality of apertures disposed therein;

a solid outer tube; and a fibrous material disposed between the inner tube and the outer tube.

13. The exhaust muffler of claim 12 wherein the fibrous material disposed between the inner tube and the outer tube comprises a fiberglass.

14. The exhaust muffler of claim 9 further comprising a conduit disposed in the outlet pipe configured to supply clean air into the outlet pipe.

15. The exhaust muffler of claim 9, wherein the aperture located in the bend of the inlet pipe has a diameter less than a diameter of the inlet pipe.

16. The exhaust muffler of claim 15, wherein the aperture has a diameter of about 0.5 to about 0.75 the diameter of the inlet pipe.

17. The exhaust muffler of claim 14 wherein the outlet pipe further comprises a venturi portion connected to the conduit configured to draw clean air into the outlet pipe.

18. The exhaust muffler of claim 9 wherein the inlet pipe includes a bridge portion through the second resonator chamber, fluidly isolating the inlet pipe from the second resonator chamber.

* * * * *